US010096924B2

(12) United States Patent
Trout et al.

(10) Patent No.: US 10,096,924 B2
(45) Date of Patent: Oct. 9, 2018

(54) HEADER CONTACT FOR HEADER CONNECTOR OF A COMMUNICATION SYSTEM

(71) Applicant: TYCO ELECTRONICS CORPORATION, Berwyn, PA (US)

(72) Inventors: David Allison Trout, Lancaster, PA (US); Justin Dennis Pickel, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/357,025

(22) Filed: Nov. 21, 2016

(65) Prior Publication Data

US 2018/0145437 A1 May 24, 2018

(51) Int. Cl.

| | |
|---|---|
| ***H01R 13/04*** | (2006.01) |
| ***H01R 12/72*** | (2011.01) |
| ***H01R 13/115*** | (2006.01) |
| ***H01R 13/6585*** | (2011.01) |
| ***H01R 12/70*** | (2011.01) |
| ***H01R 13/193*** | (2006.01) |
| ***H01R 13/6587*** | (2011.01) |

(52) U.S. Cl.

CPC ..... *H01R 13/04* (2013.01); *H01R 12/7082* (2013.01); *H01R 12/724* (2013.01); *H01R 13/115* (2013.01); *H01R 13/193* (2013.01); *H01R 13/6585* (2013.01); *H01R 13/6587* (2013.01)

(58) Field of Classification Search

CPC ..... H01R 13/6587; H01R 13/6471

See application file for complete search history.

(56) References Cited

U.S. PATENT DOCUMENTS

| | | | | |
|---|---|---|---|---|
| 5,645,459 | A | 7/1997 | Fitting | |
| 6,846,202 | B1 | 1/2005 | Schmidt et al. | |
| 7,086,913 | B2 * | 8/2006 | Myer | H01R 12/716 439/78 |
| 7,637,777 | B1 * | 12/2009 | Trout | H01R 13/4364 439/607.1 |
| 7,736,183 | B2 * | 6/2010 | Trout | H01R 13/6471 439/607.1 |
| 7,758,385 | B2 * | 7/2010 | Davis | H01R 23/688 439/626 |
| 7,896,698 | B2 * | 3/2011 | Trout | H01R 13/113 439/607.1 |

(Continued)

FOREIGN PATENT DOCUMENTS

| | | | |
|---|---|---|---|
| DE | 102006062742 | A1 | 2/2008 |
| DE | 102006053152 | B3 | 4/2008 |

*Primary Examiner* — Ross Gushi

(57) ABSTRACT

A header connector includes a header housing and a contact array of header contacts coupled to the header housing. The header contact has a mating pin at a mating end. The mating pin has a first side and a second side. The mating pin has a tip at a front of the mating pin. The mating pin has a top mating interface remote from and rearward of the tip configured to engage a first flexible contact finger of a receptacle contact. The mating pin has a bottom mating interface remote from and rearward of the tip configured to engage a second flexible contact finger of the receptacle contact. The header contact has an edge mating interface at the first side proximate to the tip configured to engage the receptacle contact.

19 Claims, 5 Drawing Sheets

(56) References Cited

U.S. PATENT DOCUMENTS 7,976,318 B2 * 7/2011 Fedder ..... H01R 13/514 439/607.11
7,988,491 B2 * 8/2011 Davis ..... H01R 13/6587 439/607.27
7,988,505 B2 8/2011 Hotea et al.
8,016,616 B2 * 9/2011 Glover ..... H01R 12/585 439/607.05
8,070,514 B2 * 12/2011 Trout ..... H01R 13/113 439/607.1
8,167,651 B2 * 5/2012 Glover ..... H01R 13/6587 439/607.08
8,187,034 B2 * 5/2012 Fedder ..... H01R 13/6587 439/607.01
8,382,522 B2 * 2/2013 Glover ..... H01R 12/585 439/607.08
8,398,431 B1 * 3/2013 Whiteman, Jr. ... H01R 13/6587 439/607.06
8,398,432 B1 * 3/2013 McClellan ..... H01R 13/6587 439/607.07
8,398,434 B2 * 3/2013 Davis ..... H01R 12/724 439/607.34
8,408,939 B2 * 4/2013 Davis ..... H01R 12/724 439/607.01
8,430,691 B2 * 4/2013 Davis ..... H01R 13/6585 439/607.09
8,469,720 B2 6/2013 Gulla
8,469,745 B2 * 6/2013 Davis ..... H01R 12/724 439/607.07
8,475,209 B1 * 7/2013 Whiteman, Jr. ..... H01R 12/724 439/607.07
8,550,861 B2 10/2013 Cohen et al.
8,579,636 B2 * 11/2013 Davis ..... H01R 12/7082 439/65
8,591,260 B2 * 11/2013 Davis ..... H01R 13/6586 439/607.55
8,597,052 B2 * 12/2013 Davis ..... H01R 13/6596 439/607.08
8,662,924 B2 * 3/2014 Davis ..... H01R 13/6477 439/607.07
8,690,604 B2 * 4/2014 Davis ..... H01R 23/688 439/607.07
8,727,791 B2 5/2014 Gulla
8,771,017 B2 * 7/2014 Vino, IV ..... H01R 13/6587 439/607.56
8,888,530 B2 * 11/2014 Trout ..... H01R 13/6585 439/607.07
8,894,435 B2 * 11/2014 Behziz ..... H01R 13/641 439/489
8,905,786 B2 * 12/2014 Davis ..... H01R 13/6587 439/108
8,992,252 B2 * 3/2015 McClellan ..... H01R 13/6587 439/108
8,998,657 B1 4/2015 Von Eckroth et al.
9,017,114 B2 4/2015 Cohen et al.
9,033,750 B2 5/2015 Miller et al.
9,054,467 B2 * 6/2015 Hamner ..... H01R 12/716
9,093,800 B2 * 7/2015 Laub ..... H01R 12/727
9,136,634 B2 * 9/2015 De Geest ..... H01R 12/724
9,190,745 B2 11/2015 Gulla
9,225,122 B1 * 12/2015 Evans ..... H01R 13/6588
9,293,845 B2 3/2016 Jeon et al.
9,425,556 B1 * 8/2016 Pickel ..... H01R 13/6582
9,559,465 B2 * 1/2017 Phillips ..... H01R 13/6461
9,570,857 B2 * 2/2017 Morgan ..... H01R 13/6471
2003/0022555 A1 * 1/2003 Vicich ..... H01R 23/688 439/607.05
2010/0151726 A1 * 6/2010 Fedder ..... H01R 13/514 439/540.1
2013/0017725 A1 * 1/2013 Davis ..... H01R 13/6587 439/607.55
2014/0194004 A1 * 7/2014 Pickel ..... H01R 13/6587 439/607.01
2016/0036165 A1 * 2/2016 Phillips ..... H01R 13/6461 439/607.05

* cited by examiner

HEADER CONTACT FOR HEADER CONNECTOR OF A COMMUNICATION SYSTEM

BACKGROUND OF THE INVENTION

The subject matter herein relates generally to header contacts for a header connector of a communication system.

Communication systems use electrical connectors to transmit data and/or power in various industries. For example, in high speed backplane systems, header and receptacle connectors are provided to interconnect various components of the communication system, such as circuit boards of the communication system. The header and receptacle connectors have corresponding contacts that are mated. The contacts require adequate contact wipe length in order to allow for system tolerances, such as to accommodate for situations when the header and receptacle connectors are not fully mated. The contact wipe length can result in an electrical stub when fully mated that can result in degradation to the signal integrity performance of the connectors.

A need remains for electrical connectors having contacts that provide adequate contact wipe length and a reduced electrical stub.

BRIEF DESCRIPTION OF THE INVENTION

In an embodiment, a header connector is provided including a header housing configured to engage a receptacle connector during a mating operation and a contact array of header contacts coupled to the header housing. Each of the header contacts has a mating pin at a mating end of the header contact configured to be electrically connected to a corresponding receptacle contact. The mating pin has a first side and a second side opposite the first side. The mating pin has a tip at a front of the mating pin. The mating pin has a top mating interface remote from and rearward of the tip configured to engage a first flexible contact finger of the receptacle contact. The mating pin has a bottom mating interface remote from and rearward of the tip configured to engage a second flexible contact finger of the receptacle contact. The header contact has an edge mating interface at the first side proximate to the tip configured to engage the receptacle contact.

In another embodiment, a communication system is provided including a receptacle connector having a contact array of receptacle contacts each having first and second flexible contacts opposing each other across a contact-receiving gap being connected by a connecting wall at a base of the receptacle contact. The communication system includes a header connector having a contact array of header contacts that engage corresponding receptacle contacts of the receptacle connector. Each of the header contacts has a mating pin at a mating end of the header contact. The mating pin has a first side and a second side opposite the first side. The mating pin has a tip at a front of the mating pin. The mating pin has a top mating interface remote from and rearward of the tip and the mating pin has a bottom mating interface remote from and rearward of the tip. The header contact has an edge mating interface at the first side proximate to the tip. The header contact is received in the contact-receiving gap of the corresponding receptacle contact during the mating operation such that the first flexible contact finger of the receptacle connector engages the top mating interface and the second flexible contact finger of the receptacle connector engages the bottom mating interface. The header contact is received in the contact-receiving gap of the corresponding receptacle contact such that the edge mating interface engages the connecting wall.

In a further embodiment, a header contact is provided including an elongated body that extends along a longitudinal axis. The elongated body has a first side and a second side opposite the first side extending between a root and a tip. The elongated body has a U-shaped profile along the longitudinal axis defined by a generally planar top arm, a generally planar bottom arm parallel to the top arm and spaced apart by a body gap, and a folded end at the second side connecting the top and bottom arms. The top arm has a top surface and a top arm edge at the first side and the bottom arm has a bottom surface and a bottom arm edge at the first side. The top surface has a top mating interface remote from and rearward of the tip and the bottom surface having a bottom mating interface remote from and rearward of the tip. The elongated body has an edge mating interface defined along at least one of the top arm edge and the bottom arm edge proximate to the tip configured to engage the receptacle contact.

DETAILED DESCRIPTION OF THE INVENTION

Embodiments set forth herein may include electrical contacts, electrical connectors having the electrical contacts, and communication systems having the electrical connectors. Embodiments may be configured to reduce electrical stubbing between electrical connectors compared to other known contacts, connectors, or systems. Although the illustrated embodiment includes electrical connectors that are used in high-speed communication systems, such as backplane or midplane communication systems, it should be understood that embodiments may be used in other communication systems or in other systems/devices that utilize electrical connectors. Accordingly, the inventive subject matter is not limited to the illustrated embodiment.

In order to distinguish similar elements in the detailed description and claims, various labels may be used. For example, an electrical connector may be referred to as a header connector, a receptacle connector, or a mating connector. Electrical contacts may be referred to as header contacts, pin contacts, electrical contacts or mating contacts. When similar elements are labeled differently (e.g., header contacts and pin contacts), the different labels do not necessarily require structural differences. For instance, in some embodiments, the header contacts described herein may be referred to as pin contacts.

Figure 1:
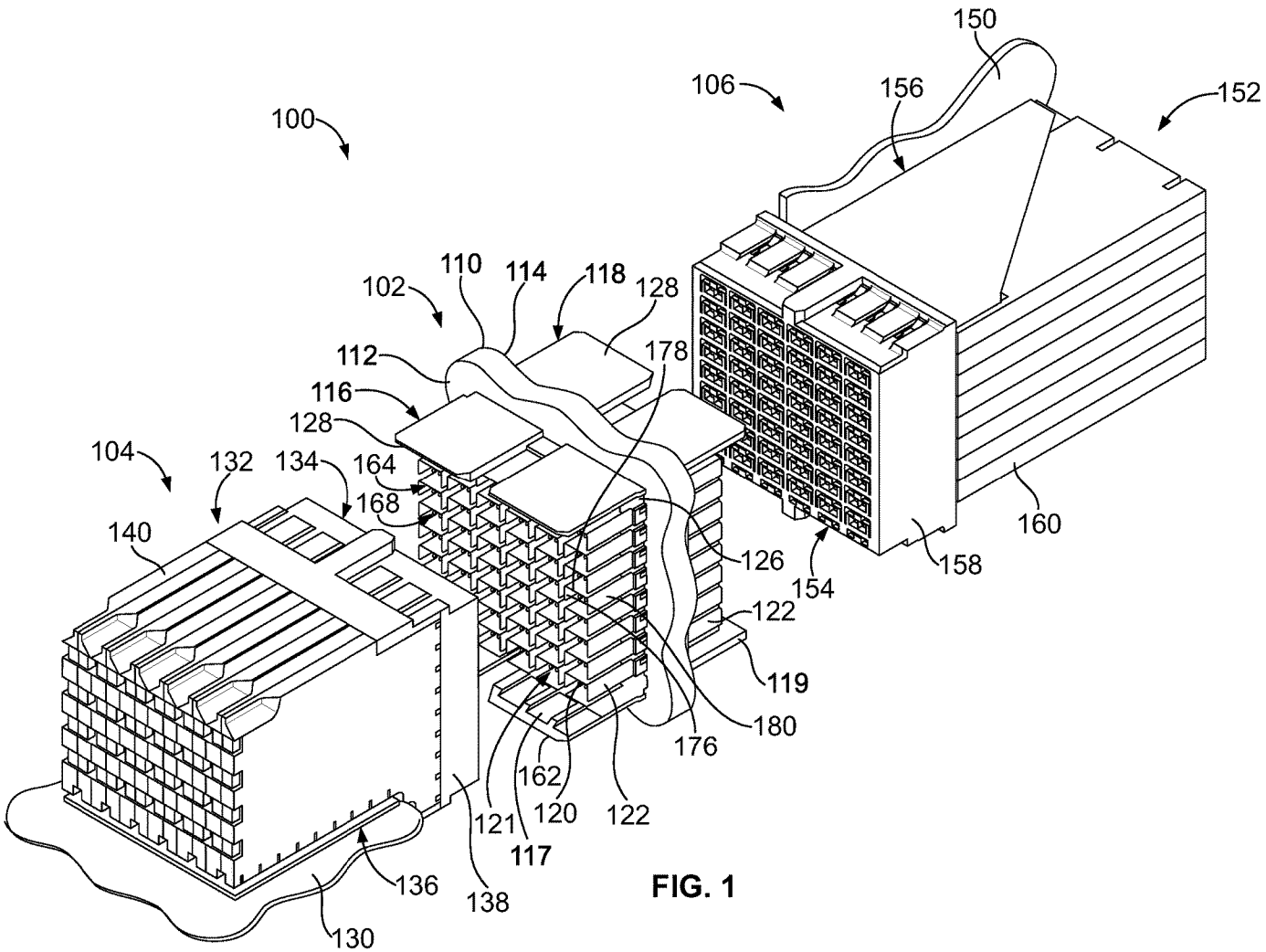
FIG. 1 is a perspective view of a communication system formed in accordance with an embodiment.

FIG. 1 is a perspective view of a communication system 100 formed in accordance with an embodiment. In particular embodiments, the communication system 100 may be a backplane or midplane communication system. The communication system 100 includes a circuit board assembly 102, a first connector system (or assembly) 104 configured to be coupled to one side of the circuit board assembly 102, and a second connector system (or assembly) 106 configured to be coupled to an opposite side the circuit board assembly 102. The circuit board assembly 102 is used to electrically connect the first and second connector systems 104, 106. Optionally, the first and second connector systems 104, 106 may be line cards or switch cards. Although the communication system 100 is configured to interconnect two connector systems in the illustrated embodiment, other communication systems may interconnect more than two connector systems or, alternatively, interconnect a single connector system to another communication device.

The circuit board assembly 102 includes a circuit board 110 having a first board side 112 and second board side 114. In some embodiments, the circuit board 110 may be a backplane circuit board, a midplane circuit board, or a motherboard. In the illustrated embodiment, the circuit board assembly 102 includes a first header connector 116 mounted to and extending from the first board side 112 of the circuit board 110. The circuit board assembly 102 also includes a second header connector 118 mounted to and extending from the second board side 114 of the circuit board 110. In alternative embodiments, the circuit board assembly 102 may include only a single header connector 116 or may include multiple header connectors 116 on the same side of the circuit board 110.

The first and second header connectors 116, 118 include header housings 117, 119, respectively. The first and second header connectors 116, 118 also include corresponding header contacts 120 that are electrically connected to one another through the circuit board 110. The header contacts 120 may be pin contacts.

The circuit board assembly 102 includes a plurality of signal paths therethrough defined by the header contacts 120 and conductive vias that extend through the circuit board 110. The header contacts 120 of the first and second header connectors 116, 118 may be received in the same conductive vias to define signal paths directly through the circuit board 110. In an exemplary embodiment, the signal paths pass straight through the circuit board assembly 102 in a linear manner. Alternatively, the header contacts 120 of the first header connector 116 and the header contacts 120 of the second header connector 118 may be inserted into different conductive vias that are electrically coupled to one another through traces (not shown) of the circuit board 110.

The first and second header connectors 116, 118 include ground shields or contacts 122 that provide electrical shielding around corresponding header contacts 120. In an exemplary embodiment, the header contacts 120 are arranged in signal pairs 121 and are configured to convey differential signals. Each of the ground shields 122 may peripherally surround a corresponding signal pair 121. As shown, the ground shields 122 are C-shaped or U-shaped and cover the corresponding signal pair 121 along three sides. The ground shields 122 may have other shapes in alternative embodiments. The header connectors 116, 118 may be provided without ground shields in alternative embodiments.

The header housings 117, 119 may be manufactured from a dielectric material, such as a plastic material. Each of the header housings 117, 119 includes a mounting wall 126 that is configured to be mounted to the circuit board 110, and shroud walls 128 that extend from the mounting wall 126. The shroud walls 128 cover portions of the header contacts 120 and the ground shields 122. The header housings 117, 119 hold the header contacts 120 and the ground shields 122 in designated positions relative to each other.

The first connector system 104 includes a first circuit board 130 and a first receptacle connector 132 that is mounted to the first circuit board 130. The first receptacle connector 132 is configured to be coupled to the first header connector 116 of the circuit board assembly 102 during a mating operation. The first receptacle connector 132 has a mating interface 134 that is configured to be mated with the first header connector 116. The first receptacle connector 132 has a board interface 136 configured to be mated with the first circuit board 130. In an exemplary embodiment, the board interface 136 is orientated perpendicular to the mating interface 134. When the first receptacle connector 132 is coupled to the first header connector 116, the first circuit board 130 is orientated perpendicular to the circuit board 110.

The first receptacle connector 132 includes a receptacle housing 138. The receptacle housing 138 is configured to hold a plurality of contact modules 140 side-by-side. As shown, the contact modules 140 are held in a stacked configuration generally parallel to one another. In some embodiments, the contact modules 140 hold a plurality of receptacle contacts 142 (shown in FIGS. 2 and 3) that are electrically connected to the first circuit board 130. The receptacle contacts 142 are configured to be electrically connected to the header contacts 120 of the first header connector 116. In an exemplary embodiment, the receptacle contacts 142 are socket contacts defining sockets that receive corresponding pin contacts defined by the header contacts 120.

The second connector system 106 includes a second circuit board 150 and a second receptacle connector 152 coupled to the second circuit board 150. The second receptacle connector 152 is configured to be coupled to the second header connector 118 during a mating operation. The second receptacle connector 152 has a mating interface 154 configured to be mated with the second header connector 118. The second receptacle connector 152 has a board interface 156 configured to be mated with the second circuit board 150. In an exemplary embodiment, the board interface 156 is orientated perpendicular to the mating interface 154. When the second receptacle connector 152 is coupled to the second header connector 118, the second circuit board 150 is orientated perpendicular to the circuit board 110.

Similar to the first receptacle connector 132, the second receptacle connector 152 includes a receptacle housing 158 used to hold a plurality of contact modules 160. The contact modules 160 are held in a stacked configuration generally parallel to one another. The contact modules 160 hold a plurality of receptacle contacts (not shown) that are electrically connected to the second circuit board 150. The receptacle contacts are configured to be electrically connected to the header contacts 120 of the second header connector 118.

The receptacle contacts of the contact modules 160 may be similar or identical to the receptacle contacts 142.

In the illustrated embodiment, the first circuit board 130 is oriented generally horizontally. The contact modules 140 of the first receptacle connector 132 are orientated generally vertically. The second circuit board 150 is oriented generally vertically. The contact modules 160 of the second receptacle connector 152 are oriented generally horizontally. As such, the first connector system 104 and the second connector system 106 have an orthogonal orientation with respect to one another.

In alternative embodiments, rather than using the midplane circuit board assembly 102 between the two connector systems 104, 106, the connector systems 104, 106 may be directly mated together. One of the connector systems 104 may define a receptacle connector system while the other connector system 106 may define a header connector system. The receptacle connector system may be identical to the connector system 104 shown in FIG. 1, while the header connector system may include the contact modules 160, but have header contacts or pin contacts at the mating interface 154 with mating ends similar to the header contacts 120.

The header connectors 116, 118 may be similar or identical. The header housing 117 includes a front end 162 that faces away from the first board side 112 of the circuit board 110. The header housing 117 defines a housing cavity 164 that opens to the front end 162 and is configured to receive the first receptacle connector 132 when the first receptacle connector 132 is advanced into the housing cavity 164. The header connector 116 includes a contact array 168 that includes the header contacts 120 and the ground shields 122. The contact array 168 may include multiple signal pairs 121.

The ground shields 122 are C-shaped and provide shielding on three sides of the signal pair 121. The ground shields 122 have a plurality of walls, such as three planar walls 176, 178, 180. The planar walls 176, 178, 180 may be integrally formed or alternatively, may be separate pieces. In an exemplary embodiment, compliant pins may extend from each of the planar walls 176, 178, 180 for reception into conductive vias of the circuit board 110 to electrically connect the planar walls 176, 178, 180 to the circuit board 110. The planar wall 178 defines a center wall or top wall of the ground shield 122. The planar walls 176, 180 define side walls that extend from the planar wall 178. The planar walls 176, 180 may be generally perpendicular to the planar wall 178. Other configurations or shapes for the ground shields 122 are possible in alternative embodiments. For example, more or fewer walls may be provided in alternative embodiments. The walls may be bent or angled rather than being planar. In other embodiments, the ground shields 122 may provide shielding for individual header contacts 120 or sets of contacts having more than two header contacts 120.

Figure 2:
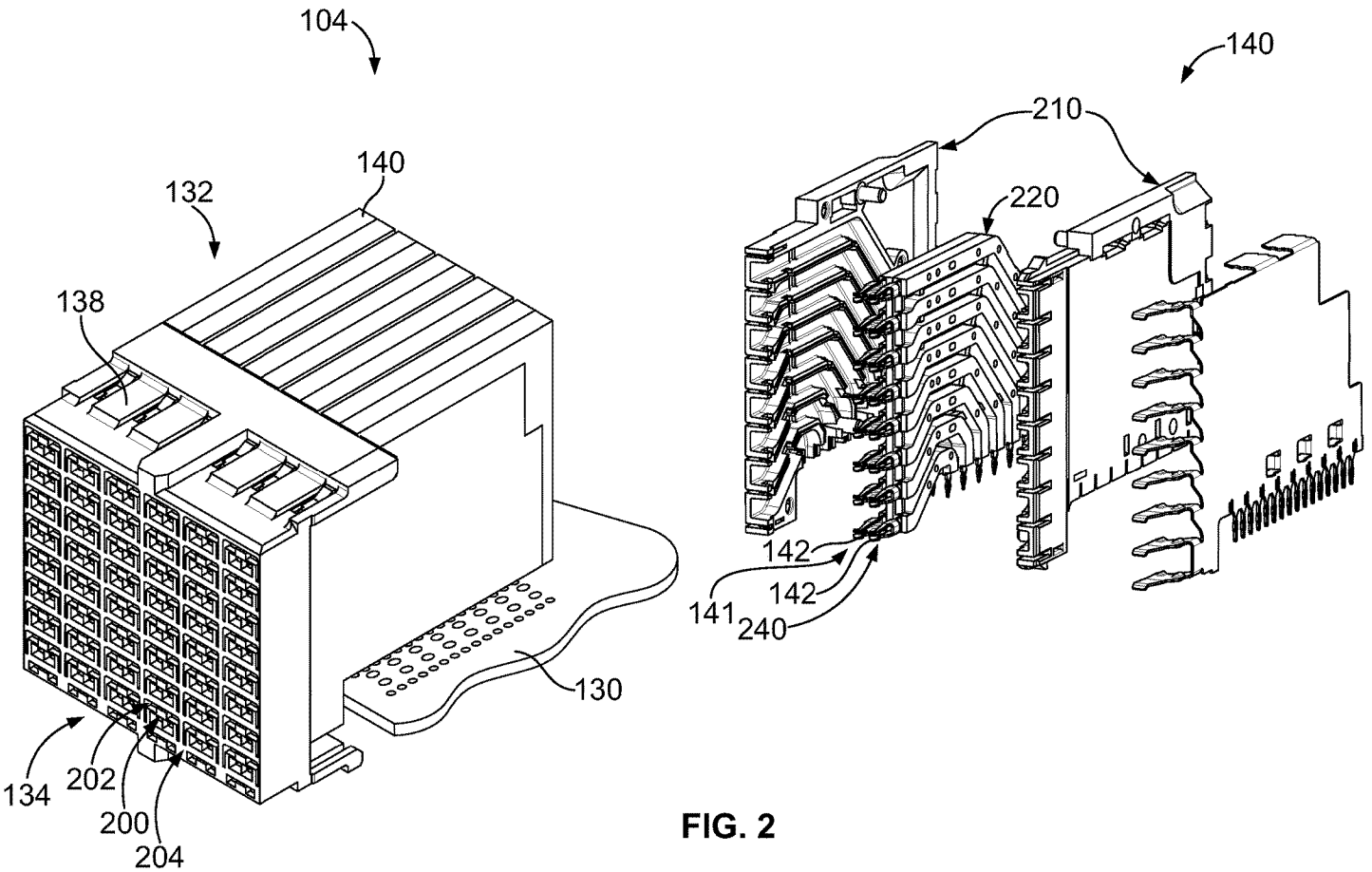
FIG. 2 is a partially exploded view of a receptacle connector of the communication system.

FIG. 2 is a partially exploded view of the first connector system 104 including the first receptacle connector 132. Although the following description is with respect to the first receptacle connector 132, the description may be similarly applied to the second receptacle connector 152 (FIG. 1). FIG. 2 illustrates one of the contact modules 140 in an exploded state. The receptacle housing 138 includes a plurality of contact channels 200, 202 at a front end 204 of the receptacle housing 138. The front end 204 defines the mating interface 134 of the first receptacle connector 132 that engages the first header connector 116 (FIG. 1).

The contact modules 140 are coupled to the receptacle housing 138 such that the receptacle contacts 142 are received in corresponding contact channels 200. Optionally, a single receptacle contact 142 may be received in each contact channel 200. The contact channels 200 are configured to receive corresponding header contacts 120 (FIG. 1) through the front end 204 when the receptacle and header connectors 132, 116 are mated. The contact channels 202 receive corresponding ground shields 122 (FIG. 1) therein when the receptacle and header connectors 132, 116 are mated.

In some embodiments, the contact module 140 includes a conductive holder 210 fabricated from a conductive material to provide electrical shielding for the first receptacle connector 132. The conductive holder 210 is configured to support a frame assembly 220 that includes a plurality of the receptacle contacts 142. The receptacle contacts 142 include mating ends 240 that extend from the frame assembly 220. The mating ends 240 are configured to be mated with corresponding header contacts 120. Optionally, the receptacle contacts 142 are arranged as signal pairs 141.

Figure 3:
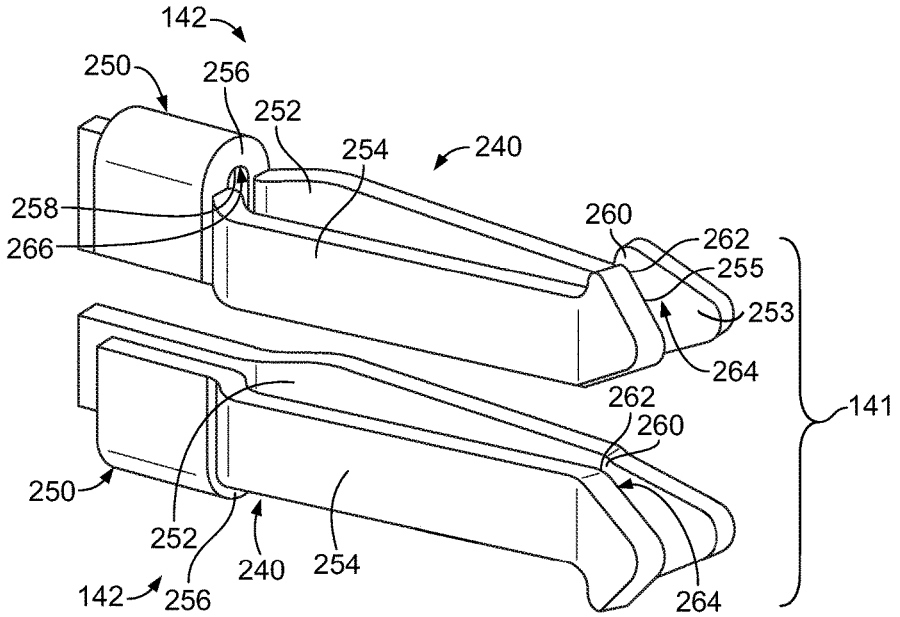
FIG. 3 is an isolated perspective view of portions of two receptacle contacts of the receptacle connector.

FIG. 3 is an isolated perspective view of portions of two receptacle contacts 142 showing the mating ends 240 of one of the signal pairs 141 of the receptacle contacts 142. Each of the receptacle contacts 142 of the signal pair 141 is configured to mechanically and electrically engage a corresponding header contact 120 (FIG. 1) of the same signal pair 121 (FIG. 1). Each of the receptacle contacts 142 may be stamped from a sheet of material and be shaped to include a contact base 250 and a pair of elongated, flexible contact fingers 252, 254 that project from the corresponding contact base 250. The flexible contact fingers 252, 254 extend on opposite sides of the socket that receives the contact 120. In an exemplary embodiment, the base 250 includes a connecting wall 256 that joins the flexible contact fingers 252, 254. The base 250 may be U-shaped defined by the roots of the flexible contact fingers 252, 254 and the connecting wall 256. The connecting wall 256 has an interior surface 258 facing the socket that receives the header contact 120. In the illustrated embodiment, the receptacle contacts 142 are similar, and may be identical. As such, the following description is applicable to each of the receptacle contacts 142. It should be understood, however, that the receptacle contacts 142 of the signal pair 141 or of the second receptacle connector 152 are not required to be identical.

The contact fingers 252, 254 have respective inner surfaces 253, 255 that face each other and, along with the interior surface 258, define the socket that receives the header contact 120 (FIG. 1). The inner surfaces 253, 255 define a contact receiving gap 264 therebetween that extends to the connecting wall 256. The inner surfaces 253, 255 form respective mating interfaces 260, 262 at a narrow portion of the contact-receiving gap 264. In the illustrated embodiment, the mating interfaces 260, 262 of the contact fingers 252, 254 are substantially paddle-shaped or tab-shaped. Each of the mating interfaces 260, 262 includes a flared portion that extends away from the opposing mating interface 260, 262 to enlarge the contact-receiving gap 264. The curved contour of the mating interfaces 260, 262 and the flared portions facilitate receiving one of the header contacts 120 (FIG. 1) within the contact-receiving gap 264.

In FIG. 3, the contact fingers 252, 254 are in a relaxed condition or state. During mating of the first header connector 116 (FIG. 1) with the first receptacle connector 132 (FIG. 1), each of the header contacts 120 is received between the contact fingers 252, 254 of a corresponding receptacle contact 142. The header contact 120 initially engages the opposing mating interfaces 260, 262 and deflects the contact fingers 252, 254 away from each other. The opposing mating interfaces 260, 262 engage opposite sides of the header contact 120 as the header contact 120 is advanced through the contact-receiving gap 264. In an exemplary embodiment, the header contact 120 is configured to engage the interior surface 258 of the connecting wall 256 at a mating interface 266 to define another point of contact with the receptacle contact 142 in addition to the contact fingers 252, 254. The mating interface 266 between the header contact 120 and the connecting wall 256 is remote from the mating interfaces 260, 262. For example, the mating interfaces 260, 262 are near the tips of the contact fingers 252, 254 while the mating interface 266 is near the roots of the contact fingers 252, 254 (for example, at the base 250). The staggered multiple points of contact reduce the length of electrical stubs formed by the receptacle contact 142 and the header contact 120.

As described in greater detail below, when the contact fingers 252, 254 are in deflected conditions, each of the contact fingers 252, 254 may generate a normal force that presses the corresponding mating interface 260, 262 against the corresponding header contact 120 in a direction toward the other mating interface 260, 262. As such, the contact fingers 252, 254 may pinch the corresponding header contact 120 therebetween. To this end, each of the contact fingers 252, 254 may be configured to provide a designated normal force when the corresponding contact finger 252, 254 is in a deflected condition. The mating interface 266 with the connecting wall 256 is oriented perpendicular to the mating interfaces 260, 262. A normal force pressing against the connecting wall 256 is perpendicular to the normal forces at the mating interfaces 260, 262.

Figure 4:
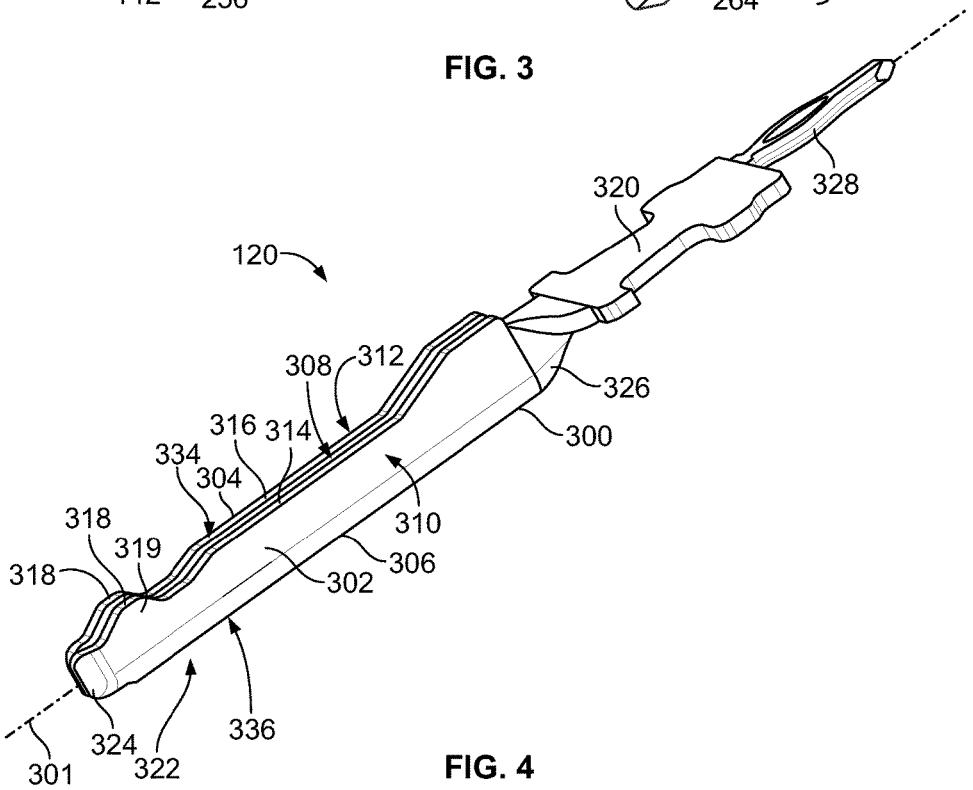
FIG. 4 is a front perspective view of a header contact of a header connector of the communication system in accordance with an exemplary embodiment.

FIG. 4 is a front perspective view of an exemplary header contact 120 in accordance with an exemplary embodiment. The header contact 120 includes an elongated body 300 that extends along a longitudinal axis 301. In the illustrated embodiment, the elongated body 300 has a U-shaped profile along the longitudinal axis 301 defined by a generally planar top arm 302 and a generally planar bottom arm 304 with a folded end 306 connecting the top and bottom arms 302, 304. Alternatively, the elongated body may be defined by a single planar arm rather than the U-shaped profile.

The header contact 120 has a base 320 and a mating pin 322 extending forward from the base 320 to a tip 324. The mating pin 322 has a root 326 opposite the tip 324, which may be provided at the base 320. The base 320 is configured to be held in the header housing 117 (shown in FIG. 1). The header contact 120 includes a mounting portion 328 extending from the base 320 opposite the mating pin 322. The mounting portion 328 may be a compliant pin configured to be received in a via of the circuit board 110 (shown in FIG. 1). The mating pin 322 has a first side 334 and a second side 336 opposite the first side 334. The top arm 302 is provided at a top of the mating pin and the bottom arm 304 is provided at a bottom of the mating pin. The arms 302, 304 extend to the first side 334. The folded end 306 is provided at the second side 336.

The bottom arm 304 is oriented generally parallel to the top arm 302. The bottom arm 304 is spaced apart from the top arm 302 by a body gap 308. The top and bottom arms 302, 304 may be formed by bending or folding over portions of the elongated body 300 of the header contact 120 into the U-shape. The top and bottom arms 302, 304 may be deflectable or compressible toward each other, such as when mated with the corresponding receptacle contact 142 (shown in FIG. 3).

The top and bottom arms 302, 304 have exterior surfaces facing in opposite directions that define top and bottom mating interfaces 310, 312 configured to engage the receptacle contact 142 (shown in FIG. 3), such as the flexible contact fingers 252, 254 (shown in FIG. 3). The top and bottom arms 302, 304 extend to corresponding top arm and bottom arm edges 314, 316 at the first side 334, which are generally opposite the folded end 306. Optionally, the top arm and bottom arm edges 314, 316 may be aligned with each other across the body gap 308.

In an exemplary embodiment, the mating pin 322 includes one or more edge mating interfaces 318 along the top arm edge 314 and/or the bottom arm edge 316. The edge mating interfaces 318 may be provided on bumps or protrusions 319 on the top arm and bottom arm edges 314, 316. The edge mating interfaces 318 are configured to engage the receptacle contact 142, such as the interior surface 258 of the connecting wall 256 (shown in FIG. 3). The edge mating interfaces 318 are longitudinally offset from the top and bottom mating interfaces 310, 312. For example, the edge mating interfaces 318 may be provided proximate to the tip 324 and the top and bottom mating interfaces 310, 312 may be provided remote from the tip 324, such as near the root 326. In an exemplary embodiment, the edge mating interface 318 is oriented generally perpendicular to the top and bottom mating interfaces 310, 312. For example, the top mating interface 310 faces a first direction (for example, upward) while the bottom mating interface 312 faces a second direction (for example, downward) opposite the first direction, and the edge mating interface 318 faces a third direction (for example, sideways) perpendicular to the first and second directions.

Figure 5:
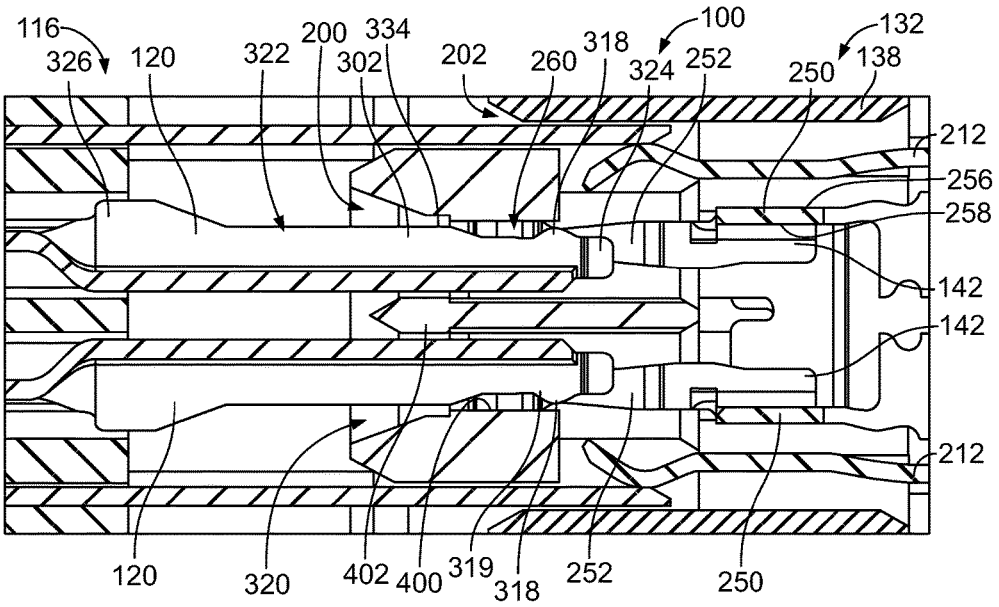
FIG. 5 is a partial sectional view of a portion of the communication system showing the header connector and the receptacle connector partially mated in accordance with an exemplary embodiment.
Figure 6:
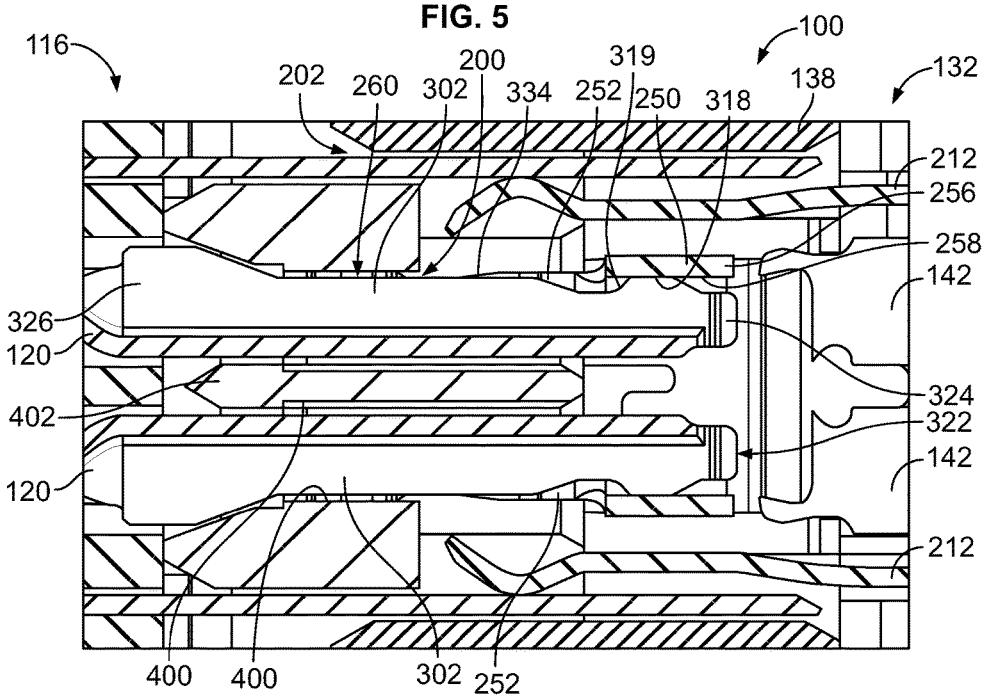
FIG. 6 is a partial sectional view of a portion of the communication system showing the header connector and the receptacle connector fully mated in accordance with an exemplary embodiment.

FIG. 5 is a partial sectional view of a portion of the communication system 100 showing the header connector 116 and the receptacle connector 132 partially mated in accordance with an exemplary embodiment. FIG. 6 is a partial sectional view of a portion of the communication system 100 showing the header connector 116 and the receptacle connector 132 fully mated in accordance with an exemplary embodiment. During mating, the header contacts 120 are inserted into the contact channels 200 for mating with the receptacle contacts 142. Similarly, the header ground shields 122 are inserted into corresponding channels 202 in the receptacle housing 138 for mating with receptacle ground contacts 212.

The receptacle housing 138 includes channel walls 400 defining the contact channels 200. The receptacle housing 138 includes a separating wall 402 between a pair of the contact channels 200 that receive the differential pairs of header contacts 120 and receptacle contacts 142. The separating wall 402 has corresponding channel walls 400. The channels walls 400 guide the header contacts 120 into the contact channels 200 and into engagement with the receptacle contacts 142. During mating, the tips 324 of the header contacts 120 are inserted into the sockets of the receptacle contacts 142, such as into the contact-receiving gaps 264 (FIG. 3) between the inner surfaces 253, 255 of the contact fingers 252, 254 (shown in FIG. 3).

The receptacle contacts 142 are positioned in the receptacle housing 138 for mating with the header contacts 120. The receptacle contacts 142 are aligned with and may be arranged in corresponding contact channels 200. For example, the contact fingers 252, 254 may be received in the contact channels 200. The separating wall 402 may be positioned between the contact fingers 252, 254. The contact fingers 252, 254 extend rearward to the base 250. The connecting wall 256, at the base 250, extends between the contact fingers 252, 254. In an exemplary embodiment, the header connector 116 and the receptacle connector 132 are mated such that the tips 324 of the header contacts 120 pass through the contact-receiving gaps 264 (FIG. 3) until the tips 324 of the header contacts 120 are at the same depth as the connecting wall 256. The edge mating interfaces 318 engage the interior surfaces 258 of the corresponding connecting walls 256 to define points of contact between the header contacts 120 and the receptacle contacts 142 at the connecting walls 256 in addition to the mating interfaces 260, 262 (shown in FIG. 3) of the contact fingers 252, 254. The mating pins 322 of the header contacts 120 are elongated to have a significant amount of wipe along the exterior surfaces of the top and bottom arms 302, 304 (shown in FIG. 4).

When fully mated (FIG. 6), the top mating interface 310 (shown in FIG. 4) engages the first flexible contact finger 252 of the receptacle contact 142 remote from and rearward of the tip 324. The top mating interface 310 is positioned proximate to the root 326. The edge mating interface 318 at the first side 334 is proximate to the tip 324, and thus remote from the top mating interface 310. The edge mating interface 318 is oriented generally perpendicular to the top and bottom mating interfaces 310, 312 (FIG. 4).

In the illustrated embodiment, the mating pin 322 includes the protrusion 319 along the first side 334. The mating pin 322 is loaded into the contact channel 200 such that the protrusion 319 interferes with the connecting wall 256. For example, the protrusion 319 extends outward far enough to the side such that the protrusion is sure to engage the connecting wall 256. Optionally, the tip 324 may be partially deflected inward by the interference between the mating pin 322 and the connecting wall 256 to create an internal spring force in the mating pin 322, thus biasing the edge mating interface 318 against the connecting wall 256.

The header contact 120 has multiple points of contact with the receptacle contact 142. For example, the header contact 120 is electrically connected to the receptacle contact 142 at the top mating interface 310, at the bottom mating interface 312, and at the edge mating interface 318. Additionally, having the points of contact longitudinally offset or staggered reduces electrical stubbing. For example, having the top mating interface 310 and the bottom mating interface 312 near the root 326 and then the edge mating interface 318 near the tip 324 reduces electrical stubbing as compared to header contacts 120 that do not have the edge mating interface 318 or another point of contact near the tip 324.

Figure 7:
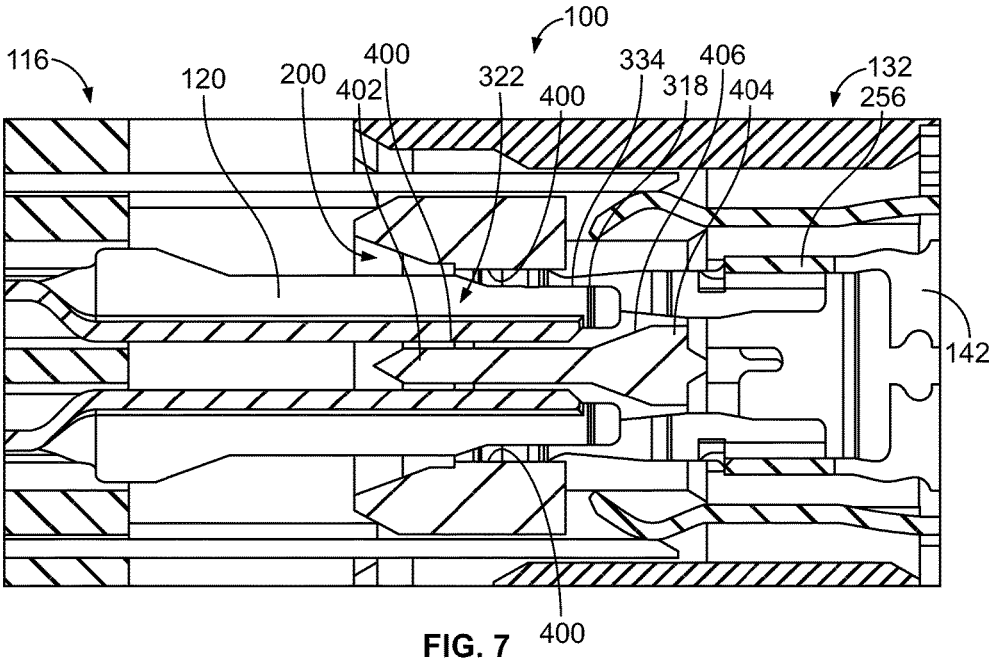
FIG. 7 is a partial sectional view of a portion of the communication system showing the header connector and the receptacle connector partially mated in accordance with an exemplary embodiment.
Figure 8:
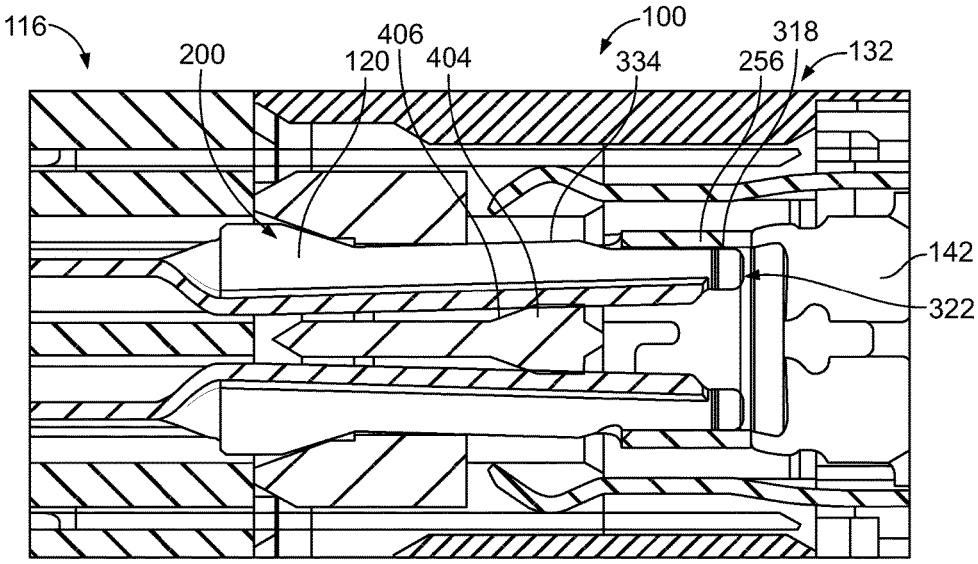
FIG. 8 is a partial sectional view of a portion of the communication system showing the header connector and the receptacle connector fully mated in accordance with an exemplary embodiment.

FIG. 7 is a partial sectional view of a portion of the communication system 100 showing the header connector 116 and the receptacle connector 132 partially mated in accordance with an exemplary embodiment. FIG. 8 is a partial sectional view of a portion of the communication system 100 showing the header connector 116 and the receptacle connector 132 fully mated in accordance with an exemplary embodiment.

The contact channels 200 include deflectors 404 along the housing walls 400. For example, the deflectors 404 are provided along the separating wall 402 and extend into the contact channels 200. The deflectors 404 force the mating pins 322 outward, such as toward the connecting walls 256 of the receptacle contacts 142, as the header connector 116 and the receptacle connector 132 are being mated. The deflectors 404 ensure that the mating pins 322 engage the connecting walls 256 when the header contacts 120 are mated with the receptacle contacts 142. In the illustrated embodiment, the deflectors 404 include ramps 406 to direct the mating pins 322 away from each other. Optionally, because the deflectors 404 force the mating pins 322 outward, the mating pins 322 do not need the protrusions 319 (shown in FIG. 4). For example, the edge mating interfaces 318 do not need to be located as far outward along the first side 334. However, the protrusions 319 may be used with the embodiment including the deflectors 404.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A header connector comprising:

a header housing configured to engage a receptacle connector; and a contact array of header contacts coupled to the header housing, each of the header contacts having a mating pin at a mating end of the header contact configured to be electrically connected to a corresponding receptacle contact, the mating pin having a first side and a second side opposite the first side, the mating pin having an elongated body extending from a root to a tip at a front of the mating pin, the mating pin having a protrusion along the first side proximate to the tip, the elongated body having a U-shaped profile defined by a generally planar top arm, a generally planar bottom arm parallel to the top arm and spaced apart by a body gap, and a folded end at the second side connecting the top and bottom arms, the top arm having a top surface and a top arm edge at the first side, the bottom arm having a bottom surface and a bottom arm edge at the first side, the mating pin having a top mating interface at the top surface remote from and rearward of the tip defining a first point of contact to the receptacle contact, the mating pin having a bottom mating interface at the bottom surface remote from and rearward of the tip defining a second point of contact to the receptacle contact, and the mating pin having an edge mating interface along at least one of the top arm edge and the bottom arm edge defined along the protrusion at the first side proximate to the tip defining a third point of contact to the receptacle contact.

2. The header connector of claim 1, wherein the mating pin extends from a root to the tip, the top and bottom mating interfaces being positioned proximate to the root.

3. The header connector of claim 1, wherein the edge mating interface is oriented perpendicular to the top and bottom mating interfaces.

4. The header connector of claim 1, wherein the top mating interface faces a first direction, the bottom mating interface faces in a second direction opposite the first direction, and the edge mating interface faces in a third direction perpendicular to the first and second directions.

5. The header connector of claim 1, wherein the second side includes an engagement surface configured to engage a deflector in the receptacle connector to press the first side outward toward the receptacle contact.

6. The header connector of claim 1, wherein the header contact is electrically connected to the receptacle contact at the top mating interface, at the bottom mating interface, and at the edge mating interface.

7. A communication system comprising:

a receptacle connector comprising a receptacle housing and a contact array of receptacle contacts held in the receptacle housing, the receptacle contacts each having first and second flexible contacts opposing each other across a contact-receiving gap, the first and second flexible contacts being connected by a connecting wall at a base of the receptacle contact; and a header connector comprising a contact array of header contacts that engage corresponding receptacle contacts of the receptacle connector, each of the header contacts having a mating pin at a mating end of the header contact, the mating pin having a first side and a second side opposite the first side, the mating pin having a tip at a front of the mating pin, the mating pin having a top mating interface remote from and rearward of the tip, the mating pin having a bottom mating interface remote from and rearward of the tip, the mating pin having an edge mating interface at the first side proximate to the tip;

wherein the header contact is received in the contact-receiving gap of the corresponding receptacle contact during the mating operation such that the first flexible contact finger of the receptacle connector engages the top mating interface and the second flexible contact finger of the receptacle connector engages the bottom mating interface, the header contact is received in the contact-receiving gap of the corresponding receptacle contact such that the edge mating interface engages the connecting wall.

8. The communication system of claim 7, wherein the receptacle housing includes contact channels receiving corresponding receptacle contacts, the contact channels receiving the header contacts when the receptacle connector is connected to the header connector, the contact channels including deflectors, the header contacts engaging the deflectors during mating to press the edge mating interfaces into the corresponding connecting walls.

9. The communication system of claim 7, wherein the mating pin extends from a root to the tip, the top and bottom mating interfaces being positioned proximate to the root.

10. The communication system of claim 7, wherein the mating pin includes a protrusion along the first side, the edge mating interface defined along the protrusion.

11. The communication system of claim 7, wherein the mating pin includes an elongated body extending from a root to the tip, the elongated body having a U-shaped profile defined by a generally planar top arm, a generally planar bottom arm parallel to the top arm and spaced apart by a body gap, and a folded end at the second side connecting the top and bottom arms, the top arm having a top surface and a top arm edge at the first side, the bottom arm having a bottom surface and a bottom arm edge at the first side, the top surface including the top mating interface, the bottom surface including a bottom mating interface, the edge mating interface being defined along at least one of the top arm edge and the bottom arm edge.

12. The communication system of claim 7, wherein the edge mating interface is oriented perpendicular to the top and bottom mating interfaces.

13. The communication system of claim 7, wherein the top mating interface faces a first direction, the bottom mating interface faces in a second direction opposite the first direction, and the edge mating interface faces in a third direction perpendicular to the first and second directions.

14. The communication system of claim 7, wherein the second side includes an engagement surface configured to engage a deflector in the receptacle connector to press the first side outward toward the receptacle contact.

15. The communication system of claim 7, wherein the header contact is electrically connected to the receptacle contact at the top mating interface, at the bottom mating interface, and at the edge mating interface.

16. A header contact comprising:

an elongated body that extends along a longitudinal axis, the elongated body having a first side and a second side opposite the first side extending between a root and a tip, the elongated body having a U-shaped profile along the longitudinal axis defined by a generally planar top arm, a generally planar bottom arm parallel to the top arm and spaced apart by a body gap, and a folded end at the second side connecting the top and bottom arms, the top arm has a top surface and a top arm edge at the first side, the bottom arm has a bottom surface and a bottom arm edge at the first side, the mating pin includes a protrusion along the first side proximate to the tip, the top surface having a top mating interface remote from and rearward of the tip defining a first point of contact to the receptacle contact, the bottom surface having a bottom mating interface remote from and rearward of the tip defining a second point of contact to the receptacle contact, the elongated body having an edge mating interface defined along at least one of the top arm edge and the bottom arm edge defined by the protrusion proximate to the tip defining a third point of contact to the receptacle contact.

17. The header contact of claim 16, wherein the mating protrusion along the first side is defined along the top arm edge and along the bottom arm edge.

18. The header contact of claim 16, wherein the edge mating interface is oriented perpendicular to the top and bottom mating interfaces.

19. The header contact of claim 16, wherein the top mating interface faces a first direction, the bottom mating interface faces in a second direction opposite the first direction, and the edge mating interface faces in a third direction perpendicular to the first and second directions.

* * * * *